United States Patent [19]

Yoshida

[11] 4,076,522

[45] Feb. 28, 1978

[54] METHOD FOR THE DESULFURIZATION OF MOLTEN IRON

[75] Inventor: Hiroshi Yoshida, Kasukabe, Japan

[73] Assignee: Aikoh Co., Ltd., Tokyo, Japan

[21] Appl. No.: 707,651

[22] Filed: Jul. 22, 1976

[30] Foreign Application Priority Data

Nov. 14, 1975 Japan ..... 50-136199

[51] Int. Cl.[2] ..... C21C 7/02; C22C 33/08

[52] U.S. Cl. ..... 75/58; 75/130 BB

[58] Field of Search ..... 75/58, 130 BB

[56] References Cited

U.S. PATENT DOCUMENTS

| | | | |
|---|---|---|---|
| 3,885,956 | 5/1975 | Obst | 75/58 |
| 3,953,198 | 4/1976 | Easwaran | 75/58 |
| 3,957,502 | 5/1976 | Cull | 75/58 |
| 3,964,899 | 6/1976 | Jones | 75/58 |

*Primary Examiner*—Peter D. Rosenberg

*Attorney, Agent, or Firm*—Fay & Sharpe

[57] ABSTRACT

A method for the desulfurization of molten iron comprising blowing into the molten iron, together with an inert gas, fine particles or powder of magnesium, which are coated with fine particles or powder of at least one selected from the group consisting of magnesia, zirconia, titania, graphite, coke, charcoal, fluorite and magnesium fluoride.

3 Claims, No Drawings

METHOD FOR THE DESULFURIZATION OF MOLTEN IRON

The present invention relates to an improvement in a desulfurizing method of molten iron.

Conventionally there are known, as desulfurizing methods of melts of pig iron, cast iron and the like, a method wherein melt is poured by arranging a desulfurizing agent in ladle, a method wherein contact effect with the desulfurizing agent on the melt surface is improved by stirring the melt through the blowing of inert gas emanated from the porous plug arranged at the bottom of ladle, a method wherein ladle is swung and the purpose of which is similarly to improve the contact effect, the impeller stirring method and the like. The desulfurizing agents used in these methods are soda ash, calcium carbide, caustic soda, magnesium and so on. These known desulfurizing methods and agents are provided with characteristic properties respectively. However, a method which is excellent in desulfurization irrespectively of the change of melt amount, melt container shape or the like and without impairing the container, is one in which a desulfurizing agent is blown into the melt by means of a carrier gas. In desulfurizing agents magnesium is excellent in reactivity and in that the subsidiary ill effects other than desulfurization to the melt is minimum so that it is recognized that the desulfurizing method of blowing magnesium into melt is the most reliable method. In using magnesium as a desulfurizing agent, however, the high reactivity of magnesium as referred to above will be disadvantageous. A greater additive amount of magnesium per hour will be explosively active, when most of the magnesium will be consumed non-reacted, so that mere blowing of pure magnesium is not effective because of explosion danger and wasteful use of magnesium. To avoid these drawbacks magnesium is used either as an alloy or being impregnated in a porous material in a method of controlling the rapid reactivity of magnesium. In the former the alloy components may sometimes be poisonous elements, and in the latter it may be difficult to manufacture so fine particles as in extent of being used for blowing and there may be fear that the impregnated magnesium might be separated due to vibrations and impact in transportation. Accordingly in the present desulfurization by said blowing method calcium carbide chiefly is employed as a desulfurizing agent, but it is necessary to employ it in large quantity and non-reacted carbide remains in slag to generate an offensive smell and an explosive gas after disuse so that there is a great possibility of raising problems such as environmental pollution and accidental explosion.

The present invention is to provide a method of carrying out an efficient desulfurization by blowing into molten iron a desulfurizing agent which has been treated to control the quick reactivity of magnesium. That is, the invention concerns a desulfurizing method of molten iron, characterized by blowing into molten iron, together with an inert gas, fine particles in size of less than 2 mm. or powder which are coated with an organic binder and one or more of magnesia, zirconia, titania, graphite, coke, charcoal, fluorspar and magnesium fluoride which have a particle size of less than 0.15 mm. Although magnesium may be controlled by coating in its sudden reactivity as referred to above, coating agent must possess more than one properties such as of cleaning the surface of magnesium whether said agent may not react with magnesium at a temperature higher than the melting point of magnesium or react with it to produce an effective material. That is, magnesia does not react with magnesium; zirconia and titania make zirconium and titanium free by magnesium to act for desulfurization and denitrogenation of molten iron; graphite, coke and charcoal have a cleaning action by reduction of the surface oxidation membrane of magnesium; and fluorspar and magnesium fluoride perform actions effective for treating molten iron, such as of making calcium free with the temperature of molten iron, removing the surface oxidation membrane of magnesium, making magnesium free or the like. Since effective particle size of magnesium is less than 2 mm. as referred to below it will be difficult to form a coating such as not expose the magnesium surface unless the fine powder is of less than 0.15 mm (about 150 mesh) to coat the magnesium surface. A binder is used to adhere a coating agent to the surface of magnesium particle. Inorganic binders such as silicic acid, silicate and phosphate, however, react with magnesium at the temperature of molten iron to produce toxic elements such as Si and P so that they are unsuitable for use. Hereupon the binders employed in this invention are organic ones. The organic binders make carbon free at the temperature of molten iron and effect an action of falling the coatings off until the time when the magnesium surface is cleaned and the coated magnesium is blown into the molten iron and floats up to the melt top. As the organic binders there are used one or more of starch, dexstrin, molasses, glue, casein, gluten, albumin, methyl cellulose, carboxymethylcellulose, phenol resin, urea resin, melamine resin, furan resin, epxoy resin, polyester resin, vinyl chloride, vinyl acetate, polyvinyl alcohol, pitch and tar. The binders are used either with solvent or by being given a fluidity through heating. Suitable solvent will be selected from among water, alcohol, ketone, ether and hydrocarbon. Magnesium proper for blowing should be as small in particle size as possible. Since the specific gravity of magnesium is smaller as 1.7 than the other treating agents, however, comparatively larger size of magnesium may be used. It will suffice in use if the size is less than 2 mm.

The desulfurizing agent used in the method of this invention is manufactured in such manner that the particles or powder of magnesium are added, while being stirred, with an organic binder which is in a liquid state or has been given a fluidity by heating, the magnesium particles or powder are uniformly mixed and moistened with said binder, and thereafter the powder of the coating agent is gradually added and adhered to the magnesium surface so that the coating layer may become thick. As the apparatus employed in the coating treatment kneader or other mixers may be useful but machines such as granulator will be better. To make the layer thick it is required to use both the coating agent and organic binder in large quantity. The quantity of adhering coating agent may almost be unified depending upon its kind according to the quantity of the organic binder adhered to magnesium, and no more coating agent might adhere, so that the particles which have finished adhering action can be given almost a uniform coating thickness. In the particles for which coating has finished, those for which solvent was used is heated to remove the solvent and then cooled to be solidified, so as to be used as the desulfurizing agent of the present invention.

The thus manufactured desulfurizing agent is blown into molten iron with nitrogen, argon, neon or the like as carrier gas. Preferably carrier gas should not react with molten iron and magnesium. Since the desulfurizing agent employed in this invention is coated on its surface, however, said agent is hardly influenced by the carrier gas, and therefore it is also possible to use nitrogen which is inactive to molten iron only. As regards the particles of the blown desulfurizing agent, the temperature-rising time of the internally stored magnesium will be slow one moment compared with the uncoated particles of desulfurizing agent owing to the temperature of molten iron. Thus the desulfurizing agent of this invention has an effect to avoid thanks to the instantaneous delay that magnesium explosively reacts, i.e. relieving the sudden reactivity of magnesium and improving the reaction effect with the melt.

The invention will now be described further by way of example.

(1) Mixing of desulfurizing agent (in terms of anhydride)

Table 1

| Mixing No. / Material | (% by weight) 1 | 2 | 3 | 4 | 5 | 6 | 7 |
|---|---|---|---|---|---|---|---|
| Core (Magnesium) | 20 | 30 | 40 | 50 | 60 | 70 | 80 |
| Coating* | 80 | 70 | 60 | 50 | 40 | 30 | 20 |

*Coating composition is described in detail in Table 2.

Table 2

| Mixing No. / Coating composition | (% by weight) 1 | 2 | 3 | 4 | 5 | 6 | 7 |
|---|---|---|---|---|---|---|---|
| Magnesia | 37 | 29 | 41 | — | 38 | — | 50 |
| Titania | 12 | 7 | — | — | — | — | — |
| Zirconia | 12 | 7 | — | — | — | — | — |
| Graphite | 7 | 14 | — | 76 | — | 33 | 30 |
| Coke | — | 7 | 34 | — | 25 | 44 | — |
| Fluosper | 3 | 4 | — | — | 12 | — | — |
| Magnesium fluoride | 2 | 3 | — | — | — | — | — |
| Phenolic resin | 27 | — | 25 | — | 25 | — | 20 |

Table 2-continued

| Mixing No. / Coating composition | (% by weight) 1 | 2 | 3 | 4 | 5 | 6 | 7 |
|---|---|---|---|---|---|---|---|
| Molasses | — | 29 | — | 24 | — | 23 | — |

(2) Desulfurizing text

Table 3 shows the result in which blowing was carried out into the molten pig iron in ladle with the use of the desulfurizing agent of the mixing in the above Tables 1 and 2, known magnesium alone and Al-Mg alloy, and with the use of nitrogen as carrier gas. In addition, in the Comparative Examples 1 and 2 there were used pure magnesium having the particle size of 3 mm and 60% Al-Mg alloy having the particle size of 1 mm respectively as desulfurizing agents.

Table 3

| | Mixing 1 | Mixing 2 | Mixing 3 | Mixing 4 | Mixing 5 | Mixing 6 | Mixing 7 | Comparative Example 1 | Comparative Example 2 |
|---|---|---|---|---|---|---|---|---|---|
| Amount (ton) of molten pig iron | 150 | " | " | " | " | " | " | " | " |
| Temperature (° C) of molten pig iron | 1300 | 1320 | 1310 | 1310 | 1340 | 1300 | 1320 | 1300 | 1310 |
| Blowing amount(Kg/ton of molten pig iron) in terms of magnesium | 0.30 | 0.25 | 0.22 | 0.295 | 0.27 | 0.36 | 0.315 | 0.33 | 0.27 |
| Blowing rate (Kg/min./ton molten pig iron) in terms of magnesium | 0.27 | 0.24 | 0.20 | 0.18 | 0.15 | 0.13 | 0.12 | 0.12 | 0.18 |
| S content(%) before desulfurization | 0.035 | 0.030 | 0.028 | 0.033 | 0.030 | 0.038 | 0.035 | 0.033 | 0.030 |
| S content (%) after desulfurization | 0.011 | 0.010 | 0.010 | 0.009 | 0.008 | 0.009 | 0.010 | 0.009 | 0.010 |
| Reaction efficiency (%) of magnesium | 61.5 | 61.5 | 62.9 | 62.6 | 62.8 | 62.0 | 61.0 | 56.0 | 57.0 |

According to the method of the present invention, the sulfur content after desulfurization became about 0.010% as described above to ensure more than 60% of the reaction efficiency irrespective of the change of original sulfur content of molten pig iron. In pure magnesium and Mg-Al alloy for which coating was not made, however, the reaction efficiency of magnesium could not reach 60%.

What I claim is:

1. A method for the desulfurization of molten iron comprising blowing into the molten iron, together with an inert gas, magnesium particles in an amount sufficient to reduce the sulfur content of said molten iron, said magnesium particles having a particle size of less than 2 mm. and being coated with fine particles having a particle size of less than 0.15 mm. which are selected from the group consisting of magnesia, zirconia, titania, graphite, coke, charcoal, fluorspar, magnesium fluoride and mixtures thereof.

2. A method according to claim 1 in which said fine particles are bonded to said magnesium particles by means of an organic binder.

3. A method according to claim 2 in which the organic binder consists of at least one material selected from the group consisting of starch, dextrin, molasses, glue, casein, gluten, alubumin, methyl cellulose, carboxymethylcellulose, phenol resin, urea resin, melamine resin, furan resin, epoxy resin, polyester resin, vinyl chloride, vinyl acetate, polyvinyl alcohol, pitch and tar.

* * * * *